US005918293A

United States Patent [19]

Lindberg et al.

[11] Patent Number: 5,918,293

[45] Date of Patent: Jun. 29, 1999

[54] IRON BASED POWDER CONTAINING MO, P AND C

[75] Inventors: Caroline Lindberg; Per Engdahl, both of Nyhamnsläge, Sweden

[73] Assignee: Höganäs AB, Höganäs, Sweden

[21] Appl. No.: 08/737,517

[22] PCT Filed: May 23, 1995

[86] PCT No.: PCT/SE95/00576

§ 371 Date: Nov. 12, 1996

§ 102(e) Date: Nov. 12, 1996

[87] PCT Pub. No.: WO95/32827

PCT Pub. Date: Dec. 7, 1995

[30] Foreign Application Priority Data

May 27, 1994 [SE] Sweden ..... 9401823

[51] Int. Cl.[6] ..... B22F 3/12; C22C 33/02; C22C 38/12

[52] U.S. Cl. ..... 75/246; 75/255; 419/38

[58] Field of Search ..... 75/246, 255; 419/38

[56] References Cited

U.S. PATENT DOCUMENTS

| | | | |
|---|---|---|---|
| 3,656,917 | 4/1972 | Kikkawa et al. | 29/193 |
| 3,793,691 | 2/1974 | Takahashi et al. | 29/182 |
| 3,806,325 | 4/1974 | Niimi et al. | 29/182.1 |
| 3,829,295 | 8/1974 | Farmer et al. | 29/182.1 |
| 3,856,478 | 12/1974 | Iwata et al. | 29/182 |
| 3,977,838 | 8/1976 | Hashimoto et al. | 29/182.5 |
| 4,664,706 | 5/1987 | Drozda | 75/246 |
| 4,696,696 | 9/1987 | Fujita et al. | 75/246 |
| 5,158,601 | 10/1992 | Fujiki et al. | 75/246 |
| 5,221,321 | 6/1993 | Lim | 75/246 |
| 5,370,725 | 12/1994 | Kawamura et al. | 75/243 |
| 5,403,371 | 4/1995 | Engdahl et al. . | |
| 5,641,922 | 6/1997 | Shivanath et al. | 75/231 |
| 5,728,238 | 3/1998 | Engdahl et al. | 148/337 |

*Primary Examiner*—Daniel J. Jenkins
*Attorney, Agent, or Firm*—Burns, Doane, Swecker & Mathis, L.L.P.

[57] ABSTRACT

An iron-based powder for producing components by powder compacting and sintering consists essentially of 0.6–2.0% by weight of Mo, 0.2–0.8% by weight of P, 0–2% by weight of Cu, 0–0.3% by weight of Mn, 0.2–0% by weight of C, and not more than 1 % by weight of inevitable impurities.

28 Claims, No Drawings

IRON BASED POWDER CONTAINING MO, P AND C

FIELD OF THE INVENTION

The present invention relates to an iron-based powder for producing components by compacting and sintering. Specifically, the invention concerns powder compositions which are essentially free from nickel and which, when sintered, give components having valuable properties. The components can be used within e.g. the car industry. The invention also concerns a component of this powder produced by powder metallurgy as well as a method of producing such a component by powder metallurgy.

BACKGROUND OF THE INVENTION

Nickel is a relatively common alloying element in iron-based powder compositions in the field of powder metallurgy, and it is generally known that nickel improves the tensile strength of the sintered components produced from iron powders containing up to 8% of nickel. Additionally, nickel promotes sintering, increases the hardenability and also has a favourable effect on the elongation. There is, however, an increasing demand for powders which do not contain nickel since, inter alia, nickel is expensive, gives dusting problems during the processing of the powder, and causes allergic reactions in minor amounts. From an environmental point of view, the use of nickel should thus be avoided.

The problem behind the present invention is thus to find a nickel-free powder composition having, at least in some respects, essentially the same properties as compositions containing nickel.

Alloying systems which are currently commercially used in this context contain Fe—P, Fe—P—C and, to some extent, Fe—Mo—P. The two carbon-free materials have moderate tensile strength and very good ductility. The Fe—P—C system gives higher strength, 450–650 MPa, but lower ductility.

Fe—P—C—Cu—Mo alloys are previously known e.g. from studies presented at the International Powder Metallurgy Conference 7 Toronto, 1984 and the International Powder Metallurgy Conference and Exhibition, Düsseldorf, 1984, which are reported in articles by Lai Ho-Yi, Liu Changxi, and Yin Hongyu.

The first article concerns an investigation of the distribution of phosphorus in sintered iron-base alloys and the question of whether phosphorus segregates into grain boundaries. The purpose of the investigation is to establish the effect of the distribution of phosphorus in a sintered Fe—P—C—Cu—Mo alloy and its effect on the mechanical properties and fracture modes after sintering and heat treatment.

The second article concerns a work whose purpose was to find out whether phosphorus causes temper brittleness in sintered alloys and to study the mechanical properties, the microstructure and the fracture surfaces of Fe—P—C—Cu—Mo alloys after sintering and heat treatment.

Both articles concern alloys whose Mo content is lower than that of the compositions according to the present invention. The main object of the present invention, however, is to provide products which, after both low- and high-temperature sintering, have high tensile strength without any subsequent heat treatment. The problems solved by the present invention are thus different from the problems discussed in the articles.

Patent Publications WO71919582 and 91/18123 (corresponding to Swedish Patent Publication 468 466) concern powder compositions containing Fe, Mo, P and C. Both publications disclose powder compositions which are different from the compositions according to the present invention and which, owing to their different properties, are intended for other purposes.

International Patent Publication WO 91/19582 discloses compositions to be used for the preparation of impact-resistant components, i.e. components having/high impact energy. An important feature of these known compositions is that the carbon content is low, i.e. below 0.1% by weight. Besides, the impact energy indicates the ductility of a material, and an increased ductility is generally accompanied by decreased tensile strength. Accordingly, this publication does not teach how to obtain high tensile strength.

WO 91718123 discloses powder compositions, whose Mo (or W and Mo) content varies between 3% and 15% by weight. In this case, Mo is added in order to improve the high-temperature strength and the wear resistance. The lower limit is selected in view of the fact that a sufficient amount of carbide-forming element is required to provide the desired wear resistance and high-temperature strength.

The development of the compositions according to the present invention has quite unexpectedly made it possible to increase the tensile strength to values above 800 MPa.

The metal powders according to the present invention consist, in addition to iron and the inevitable impurities, essentially of 0.6–2.0% by weight of Mo, 0.2–0.8% by weight of P, 0–2% by weight of Cu, 0–0.3% by weight of Mn and 0.2–0.8% by weight of C. Inevitable impurities in an amount up to about 1% by weight of the metal powder can also be present. Examples of impurities are S, Si, Cr and Ni.

Mo might be admixed or diffusion-bonded to the iron powder, but is preferably pre-alloyed with Fe, and P is preferably added in the form of iron phosphide, preferably $Fe_3P$.

The addition of Mo increases the hardenability of the material, and the amount of Mo should therefore be at least 0.6% by weight. However, since increasing amounts of Mo decreases the compressibility and, accordingly, the density, the amount of Mo should preferably be less than about 2.0 % by weight.

Increasing amounts of P increase the amount of liquid phase during sintering, which makes the pores rounder, facilitates the P distribution and enhances the strength of the material. Increasing amounts of P also increase the hardenablity and the strength of the material. If excessive amounts of P are used, $Fe_3P$ is formed during the cooling, which embrittles the material when formed in the grain boundaries.

If the amount of C, which is normally added as a graphite powder, is less than 0.2%, the tensile strength will be too low, and if the amount of C is above 0.8% the sintered component will be too brittle. Components prepared from compositions according to the present invention, whose C content is relatively low, exhibit good ductility and acceptable tensile strength, whereas products prepared from compositions containing higher amounts of C have lower ductility and increased tensile strength. Thus, strength levels of up to 800 MPa have been obtained when the present compositions were sintered at 1250° C. When sintering at 1120° C., strength values of about 670 MPa were obtained. The preferred compositions for both temperatures contained 0.4–0.5% of P, 0.5–0.6% of C and 0.7–1.7% of Mo.

The powders according to the present invention may also include Cu as an optional alloying element. Cu increases the hardenability and, accordingly, the tensile strength of the material. High amounts of Cu adversely affect the density as a result of swelling. Also Mn can be added as an optional element in order to improve the harden-ability. However, high amounts of Mn result in oxidation problems.

In addition to the optional alloying elements Cu and Mn, the metal powders according to the present invention may include impurities, such as S, Si, Cr and Ni, preferably in an amount less than 1% by weight of the total powder composition.

In a preferred embodiment of the invention Astaloy® Mo (available from Höganäs AB, Sweden) is used as a base powder. To this powder, which contains 1.5 % of Mo and 0.1% of Mn, is added phosphorus, such as ferrophosphorus, having an average particle size of about 10 $\mu$m and a P content of about 15.6%.

Powder compositions containing Mo, P and C are previously known from Patent Application WO 91/19582. In these compositions, however, the amount of C should be less than 0.1% and, additionally, nickel might be included as an optional agent in order to increase the impact energy of the sintered products, which is the main object of this patent application. The addition of C to these known compositions containing Fe, Mo and P according to the present invention enhances the hardenability of the material and increasing amounts of C increase the tensile strength. Moreover, this C addition drastically decreases the shrinkage during sintering. Also the impact energy will be decreased.

The invention will be described in more detail in the following Example.

EXAMPLE

Astaloy® Mo was used as a base powder, and ASC100.29 (a pure iron powder commercially available from Höganäs AB, Sweden) was used as a reference powder in some tests. Phosphorus was added as ferrophosphorus with an average particle size of 10 $\mu$m and a P content of 15.6%. Graphite was added as ultrafine from Kropfmühl (Germany). 0.8% of zinc stearate was added to all mixtures. Phosphorus and graphite additions were made in amounts of up to 0.7%.

The tensile strength and the impact strength test bars were pressed at 600 MPa and sintered at 1120° C. and 1250° C. The sintering time was 30 minutes, and the atmosphere was 25/75 $N_2/H_2$ or 95/5 $N_2/H_2$.

The results are summarised in the following table, wherein "HV10" is the Vicker hardness, "TS" is the tensile strength and "A" is the elongation.

| | T (°C.) | % Mo | % P | % C | % Cu | % Mn | HV10 | TS (MPa) | A (%) |
|---|---|---|---|---|---|---|---|---|---|
| Mo content | | | | | | | | | |
| 16. | 1250 | — | 0.4 | 0.5 | — | — | 147 | 515 | 6.9 |
| 17. | " | 1.5 | 0.4 | 0.5 | — | 0.1 | 232 | 813 | 1.7 |
| I. | 1120 | 0.85 | 0.5 | 0.6 | — | 0.1 | 180 | 608 | 1.6 |
| II. | " | 1.5 | 0.5 | 0.6 | — | 1.5 | 245 | 682 | 0.6 |
| III. | " | 2.5 | 0.5 | 0.6 | — | — | 269 | 517 | 0.3 |
| P content | | | | | | | | | |
| X | 1120 | 1.5 | 0 | 0.5 | — | 0.1 | 159 | 508 | 1.8 |
| H | " | 1.5 | 0.3 | 0.5 | — | 0.1 | 176 | 633 | 1.9 |
| K | " | 1.5 | 0.6 | 0.5 | — | 0.1 | 202 | 591 | 1.4 |
| L | " | 1.5 | 0.7 | 0.5 | — | 0.1 | 235 | 602 | 1.4 |
| C content | | | | | | | | | |
| Y | 1120 | 1.5 | 0.5 | — | — | 0.1 | 120 | 425 | 17 |
| M | " | 1.5 | 0.5 | 0.4 | — | 0.1 | 208 | 589 | 2.4 |
| N | " | 1.5 | 0.5 | 0.6 | — | 0.1 | 273 | 832 | 1.2 |
| O | " | 1.5 | 0.5 | 0.7 | — | 0.1 | 308 | 728 | 0.5 |
| Cu content | | | | | | | | | |
| E | 1120 | 1.5 | 0.4 | 0.3 | — | 0.1 | 159 | 492 | 3.9 |
| G | " | 1.5 | 0.4 | 0.3 | 1.5 | 0.1 | 218 | 680 | 1.7 |
| E | 1250 | 1.5 | 0.4 | 0.3 | — | 0.1 | 143 | 532 | 4.5 |
| G | " | 1.5 | 0.4 | 0.3 | 1.5 | 0.1 | 178 | 697 | 1.9 |

We claim:

1. An iron-based powder for producing components by powder compacting and sintering essentially consisting of 0.6–2.0% by weight of Mo, 0.2–0.8% by weight of P, 0–2 % by weight of Cu, 0–0.3% by weight of Mn, and 0.2–0.8% by weight of C, and not more than 1% by weight of inevitable impurities.

2. A powder according to claim 1, characterised in that the amount of Mo is 0.7–1.7 % by weight.

3. A powder according to claim 1, characterised in that the amount of P is 0.4–0.5 % by weight.

4. A powder according to claim 1, characterised in that P is present in the form of iron phosphide, preferably $Fe_3P$.

5. A powder according to claim 2, characterised in that the amount of C is 0.5–0.6% by weight.

6. A powder according to claim 1, characterised in that Mo is pre-alloyed with the iron powder.

7. A component produced by powder metallurgy, which in addition to Fe essentially consists of 0.6–2.0% by weight of Mo, 0.2–0.8% by weight of P, 0–2 % by weight of Cu, 0–0.3% by weight of Mn, and 0.2–0.8% by weight of C, and not more than about 1% by weight of inevitable impurities.

8. A method of producing sintered components by powder metallurgy, characterised by using an iron-based powder which, in addition to Fe, essentially consists of 0.6–2.0% by weight of Mo, 0.2–0.8% by weight of P, 0–2 % by weight of Cu, 0–0.3% by weight of Mn, and 0.2–0.8% by weight of C, and not more than 1% by weight of inevitable impurities, compacting the powder into the desired shape; and sintering the compact.

9. A powder according to claim 2, characterized in that the amount of P is 0.4–0.5% by weight.

10. A powder according to claim 2, characterized in that P is present in the form of iron phosphide, preferably $Fe_3P$.

11. A powder according to claim 3, characterized in that P is present in the form of iron phosphide, preferably $Fe_3P$.

12. A powder according to claim 9, characterized in that P is present in the form of iron phosphide, preferably $Fe_3P$.

13. A powder according to claim 2, characterized in that the amount of C is 0.5–0.6% by weight.

14. A powder according to claim 2, characterized in that Mo is pre-alloyed with the iron powder.

15. A powder according to claim 3, characterized in that Mo is pre-alloyed with the iron powder.

16. A powder according to claim 4, characterized in that Mo is pre-alloyed with the iron powder.

17. A powder according to claim 5, characterized in that Mo is pre-alloyed with the iron powder.

18. A powder according to claim 9, characterized in that Mo is pre-alloyed with the iron powder.

19. A powder according to claim 10, characterized in that Mo is pre-alloyed with the iron powder.

20. A powder according to claim 13, characterized in that Mo is pre-alloyed with the iron powder.

21. A powder according to claim 1, characterized in that the Mo content is effective to provide high tensile strength after low temperature sintering and without a subsequent heat treatment.

22. A powder according to claim 1, characterized in that the Mo content is effective to provide high tensile strength after high temperature sintering and without a subsequent heat treatment.

23. A powder according to claim 1, characterized in that the powder is formed into a sintered product having a tensile strength of over 700 MPa.

24. A powder according to claim 1, characterized in that the powder is formed into a sintered product having a tensile strength of over 800 MPa.

25. A powder according to claim 1, characterized in that the P content is effective to enhance tensile strength by sintering the powder and providing rounder pores during sintering.

26. A powder according to claim 1, characterized in that the P content is 0.4 to 0.5%, the C content is 0.5 to 0.6% and the Mo content is 0.7 to 1.7%.

27. A powder according to claim 1, characterized in that the Mo content is about 1.5%, the P content is about 0.4% and the C content is about 0.3%.

28. A powder according to claim 1, characterized in that the powder is formed into a sintered product having an elongation of at least 0.5%.

* * * * *